US008474525B2

(12) United States Patent
Van De Vliert

(10) Patent No.: US 8,474,525 B2
(45) Date of Patent: Jul. 2, 2013

(54) GEOTHERMAL LINER SYSTEM WITH PACKER

(76) Inventor: David R. Van De Vliert, Edmonton (CA)

( * ) Notice: Subject to any disclaimer, the term of this patent is extended or adjusted under 35 U.S.C. 154(b) by 422 days.

(21) Appl. No.: 12/562,736

(22) Filed: Sep. 18, 2009

(65) Prior Publication Data

US 2011/0067855 A1 Mar. 24, 2011

(51) Int. Cl.
*E21B 33/12* (2006.01)
*E21B 33/124* (2006.01)

(52) U.S. Cl.
USPC ..... 166/191; 166/387; 166/180; 166/150; 166/332.1

(58) Field of Classification Search
USPC ..... 166/180, 181, 191, 387, 118, 119, 166/150, 317, 332.1, 381
See application file for complete search history.

(56) References Cited

U.S. PATENT DOCUMENTS

| | | | | | |
|---|---|---|---|---|---|
| 2,368,428 | A * | 1/1945 | Saurenman | ..... | 166/114 |
| 3,010,515 | A * | 11/1961 | Harrison et al. | ..... | 166/54.5 |
| 3,194,312 | A * | 7/1965 | Thomas | ..... | 166/285 |
| 3,244,233 | A * | 4/1966 | Villalon, Jr. | ..... | 166/123 |
| 3,291,219 | A * | 12/1966 | Nutter | ..... | 166/145 |
| 3,631,926 | A * | 1/1972 | Young | ..... | 166/134 |
| 3,993,130 | A * | 11/1976 | Papp | ..... | 166/330 |
| 4,155,404 | A * | 5/1979 | Hollingsworth | ..... | 166/285 |
| 4,270,761 | A * | 6/1981 | Hertz, Jr. | ..... | 277/336 |
| 5,195,583 | A * | 3/1993 | Toon et al. | ..... | 166/187 |
| 5,509,483 | A * | 4/1996 | Graen | ..... | 166/382 |
| 6,382,234 | B1 * | 5/2002 | Birckhead et al. | ..... | 137/74 |
| 6,581,682 | B1 * | 6/2003 | Parent et al. | ..... | 166/180 |
| 6,691,788 | B1 * | 2/2004 | Dearing | ..... | 166/382 |
| 6,848,505 | B2 | 2/2005 | Richard et al. | | |
| 6,892,819 | B2 * | 5/2005 | Cook et al. | ..... | 166/380 |
| 6,896,061 | B2 * | 5/2005 | Hriscu et al. | ..... | 166/313 |
| 6,978,840 | B2 * | 12/2005 | Henderson | ..... | 166/380 |
| 7,121,352 | B2 | 10/2006 | Cook et al. | | |
| 7,143,832 | B2 | 12/2006 | Fyer | | |
| 7,228,915 | B2 | 6/2007 | Thomson | | |
| 7,284,619 | B2 | 10/2007 | Stokley et al. | | |
| 7,314,092 | B2 | 1/2008 | Telfer | | |
| 7,373,973 | B2 | 5/2008 | Smith et al. | | |
| 7,387,158 | B2 | 6/2008 | Murray et al. | | |
| 7,387,170 | B2 | 6/2008 | Doane et al. | | |
| 7,392,851 | B2 | 7/2008 | Brennan, III et al. | | |
| 7,404,437 | B2 | 7/2008 | Brezinski et al. | | |
| 7,647,980 | B2 * | 1/2010 | Corre et al. | ..... | 166/387 |
| 7,753,131 | B2 * | 7/2010 | Brooks | ..... | 166/387 |
| 7,891,431 | B2 * | 2/2011 | Freyer | ..... | 166/387 |
| 7,994,257 | B2 * | 8/2011 | De et al. | ..... | 166/387 |
| 8,157,019 | B2 * | 4/2012 | King et al. | ..... | 166/387 |

(Continued)

*Primary Examiner* — Kenneth L Thompson
(74) *Attorney, Agent, or Firm* — Andrew W. Chu; Craft Chu PLLC

(57) ABSTRACT

A geothermal liner system with packer for sealing a producing zone within a wellbore has a mandrel placed in an interior of the wellbore, a packer releasably affixed around an outer surface of the mandrel, and a sleeve positioned adjacent an end of the mandrel. The liner system is generally tubular and may include joint casings and a mandrel, all being tubular-shaped. The packer is expandable upon exposure to wellbore conditions. The sleeve has perforations in a wall thereof. The mandrel is slidable relative to the packer when the packer expands against the wellbore. The sleeve is selectively controlled to manage production from sealed wellbore zones. The system is stabilized through various wellbore conditions, such as geothermal heat, by being adjustable for thermal expansion of parts of the system.

18 Claims, 6 Drawing Sheets

U.S. PATENT DOCUMENTS

| | | | | |
|---|---|---|---|---|
| 8,191,643 | B2 * | 6/2012 | Nutley et al. | 166/387 |
| 2003/0150622 | A1 * | 8/2003 | Patel et al. | 166/373 |
| 2007/0267201 | A1 * | 11/2007 | Brezinski et al. | 166/387 |
| 2008/0135225 | A1 * | 6/2008 | Patel et al. | 166/50 |
| 2008/0314600 | A1 * | 12/2008 | Howard et al. | 166/387 |
| 2009/0145605 | A1 * | 6/2009 | Kratochvil et al. | 166/301 |
| 2009/0294137 | A1 * | 12/2009 | Meijer | 166/387 |
| 2010/0044028 | A1 * | 2/2010 | Brooks | 166/179 |
| 2010/0243270 | A1 * | 9/2010 | Ingram et al. | 166/377 |
| 2010/0288486 | A1 * | 11/2010 | Kutac | 166/118 |
| 2010/0319927 | A1 * | 12/2010 | Yokley et al. | 166/373 |

* cited by examiner

GEOTHERMAL LINER SYSTEM WITH PACKER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the production of fluids within a wellbore. More particularly, the present invention relates to the isolation of producing zones within a wellbore using a liner system of a liner with packers. More particularly, the present invention relates to sealing a mandrel of the liner within a wellbore using packers that prevent fluids from flowing between producing zones. Additionally, the present invention relates to packers that allow mandrels of the liner to slide longitudinally therein, so as to account for exposure to wellbore conditions.

2. Description of Related Art Including Information Disclosed Under 37 CFR 1.97 and 37 CFR 1.98.

It is well known that land formations that produce oil and gas have different "zones" where different mixtures of oil and gas are produced, where other fluids—such as water—are produced, and where no fluids are produced at all. An oil and gas wellbore can pass through any number and combination of these zones so as to maximize the production of oil and gas from the land formation.

Open-hole completions are commonly used for producing oil and gas in a wellbore. Open-hole completions are particularly useful in slant-hole wells. In these wells, the wellbore may be deviated and run horizontally for thousands of feet through a producing zone. It is often desirable to provide annular isolators, or packers, along the length of the horizontal production tubing to allow selective production from, or isolation of, various portions of the producing zone.

In open-hole wells, standard casing is cemented only into upper portions of the well, and not through the producing zones. A liner then runs from the bottom of the cased portion of the well down through the various zones in the wellbore. In a typical production of oil and gas in a wellbore, production tubulars or casings are inserted in the wellbore. In open-hole completions, nothing supports the wellbore from collapse upon itself. Thus, the liner is used to fill the interior of the wellbore and to support the walls of the wellbore. Liners are typically run into uncased portions of wellbores. It is desirable for liners to minimize the annular space between the liner and the wellbore wall so as to provide mechanical support and restrict or prevent annular flow of fluids outside the production tubing of the liner. However, due to irregularities in the wellbore wall, liners do not prevent annular flow in the wellbore. For this reason, a liner system includes packers that are used to stop annular flow of fluids around the liner. Packers provide annular seals, or barriers, between the liner and the wellbore wall to isolate various zones within the wellbore and along the liner. A mandrel and a packer are components that can be installed in the liner, along with the regular tubular joint casings as part of a liner system.

A problem associated with oil and/or gas production within a wellbore is that when a wellbore passes through certain zones, such as a water zone, water can enter the annular space between the liner and the wellbore wall and mix with oil and/or gas. Thus, there is a need to isolate water zones (or other non-desirable zones) from oil and/or gas zones.

Another problem associated with oil and/or gas production within a wellbore is that various production zones can have different natural pressures. Zones of different pressures must be isolated from each other so as to prevent flow in the wrong direction and to allow production from the low pressure zones. Thus, where multiple zones are penetrated by the same wellbore, there is a need to isolate the zones to allow separate control of fluid flow in each zone for more efficient oil and/or gas production.

A problem associated with typical liner systems is the inability to move the liner relative to the packers once the packers have expanded within the wellbore. Thus, there is a need for a liner system with a liner and packers that allows for the longitudinal movement of the liner relative to the expanded packers within the wellbore.

Various patents have been issued relating to liner systems. For example, U.S. Pat. No. 7,404,437, issued on Jul. 29, 2008 to Brezinski et al., discloses an apparatus and method for forming an annular isolator in a borehole after the installation of production tubing Annular seals are carried in or on production tubing as it is run into a borehole. In conjunction with expansion of the tubing, the seals are deployed to form annular isolators. An inflatable element carried on the tubing can be inflated with a fluid carried in the tubing and forced into the inflatable element during expansion of the tubing. Reactive chemicals can be carried in the tubing and injected into the annulus to react with each other and also with ambient fluids so as to increase in volume and harden into an annular seal. An elastomeric sleeve, ring, or band carried on the tubing may be expanded into contact with a borehole wall and may have its radial dimension increased in conjunction with tubing expansion to form an annular isolator.

U.S. Pat. No. 7,373,973, issued on May 20, 2008 to Smith et al., discloses a bridge plug having a segmented backup shoe, and a split-cone extrusion limiter. The extrusion limiter has a two-part conical retainer positioned between packer elements and the segmented backup shoe. The extrusion limiter blocks packer element extrusion though spaces between backup shoe segments. In one embodiment, two split-cone extrusion limiters are used together and positioned so that each split cone extrusion limiter covers gaps in the other extrusion limiter. The two split-cone extrusion limiters block packer element extrusion though gaps between backup shoe segments regardless of their orientation relative to the segmented backup shoe. In another embodiment, a solid retaining ring is positioned between a split retaining cone extrusion limiter and a packer element. The solid retaining ring resists extrusion of packer elements into spaces in the split-cone extrusion limiter or limiters.

U.S. Pat. No. 7,392,851, issued on Jul. 15, 2008 to Brennan, III et al., discloses an inflatable packer assembly that has a first expandable tubular element having a pair of ends, a first pair of annular end supports for securing the respective ends of the first tubular element about a mandrel disposed within the first tubular element, and a first annular bracing assembly deployable from one of the end supports for reinforcing the first tubular element upon pressurization and expansion thereof. An end of the first annular bracing assembly is pivotally connected to one of the end supports for reinforcing the first tubular element upon pressurization and expansion thereof. An opposite end of the first annular bracing assembly is expandable. One of the end supports is movable. The other end support is fixed with respect to the mandrel. The first annular bracing assembly has a slats arranged in an annular configuration and pivotally connected at one of to the movable end support. Each of the slats has a width that increases from its pivotally connected end to its other end.

U.S. Pat. No. 7,387,170, issued on Jun. 17, 2008 to Doane et al., discloses a packer device that includes a central packer mandrel and a radially-surrounding expansion mandrel. A slip mandrel carrying wickers surrounds the expansion mandrel and is secured in place upon the expansion mandrel by an annular retaining ring. The slip mandrel is secured to the retaining ring by screw connectors that pass through the slip mandrel and into retainer segments. The retaining ring is clamped between the slip mandrel and segments. The packer device carries a fluid seal that is made up of a thermoplastic material with elastomeric energizing elements.

U.S. Pat. No. 7,387,158, issued on Jun. 17, 2008 to Murray et al., discloses a packer that has a main sealing element that swells after a delay that is long enough to get the sealing element into a proper position. A sleeve is removed from the packer so as to allow well fluids to contact the main sealing element so as to start the swelling process. The main sealing element swells until the surrounding tubular or the surrounding wellbore is sealed. Sleeves that remain above and below the main sealing element preferably swell in a longitudinal direction so as to abut the main sealing element and increase the contact pressure of the main sealing element against the surrounding tubular or wellbore. The longitudinally-swelling members can be covered to initiate their growth after the main sealing element has started or completed a swelling action. The longitudinally-swelling members can be constrained against radial growth to direct swelling action in a longitudinal direction. Extrusion barriers above and below the main sealing element can optionally be used.

U.S. Pat. No. 7,314,092, issued on Jan. 1, 2008 to Telfer, discloses a packer tool for mounting on a work string that has a body with packer elements thereon, and a sleeve positioned around the packer elements so as to compress the packer elements. The packer tool is set by movement of the tool body relative to the sleeve. The sleeve includes a retaining member. The retaining member is removable between a first and a second position. In the first position, the retaining member prevents movement of the sleeve relative to the tool body so as to prevent setting of the packer tool. In the second position, the retaining member releases the tool body so as to arrest a movement of the sleeve. In the second position, the retaining member also facilitates compression of the packer elements so that the tool can be set.

U.S. Pat. No. 7,143,832, issued on Dec. 5, 2006 to Fyer, discloses an annular packer arranged on the outside of the production tubing. The packer has a core that has an elastic polymer that swells by the addition of hydrocarbons. The core can be surrounded by an external mantel of rubber. The external mantel of rubber is permeable to hydrocarbons and may be equipped with a reinforcement. The core swells by absorption of hydrocarbons and the packer expands accordingly. The expansion of the packer seals the annular space between the production tubing and the well wall.

U.S. Pat. No. 6,848,505, issued on Feb. 1, 2005 to Richard et al., discloses a method of sealing casing or liners in a wellbore. Strands of casing or liners receive a jacket bonded to the outer surface. Preferably, the jacket is a rubber compound bonded to the outer wall. The rubber compound swells at a predetermined rate in response to contact with fluids in the well. The casing or liner can be expanded with a swage preferably prior to the onset of the swelling of the jacket. Packers and sealing hangers can be added at the extremes of the casing or liner string to further secure against channeling between adjacent formations.

U.S. Pat. No. 7,228,917, issued on Jun. 12, 2007 to Thomson, discloses an apparatus and method for creating a seal in a bore hole annulus. A conduit within a wellbore has an outer surface covered with an elastomeric material that can expand and/or swell when the material comes into contact with an actuating agent. The conduit is an expandable conduit. The conduit is located inside a second conduit and radially expanded therein. The actuating agent can be naturally occurring in the bore hole or can be injected or pumped into the bore hole so as to expand or to swell the elastomeric material to create the seal.

U.S. Pat. No. 7,121,352, issued on Oct. 17, 2006 to Cook et al., discloses an apparatus that has a zone-isolation assembly. The assembly has a solid tubular member. The solid tubular member has external seals. A perforated tubular member is coupled to the solid tubular member. A shoe is coupled to the zone-isolation assembly. The perforated tubular members include an elastic sealing member that is coupled to the perforated tubular member. The elastic sealing member covers the perforations of the perforated tubular member.

It is an object of the present invention to control the flow of fluids in a producing wellbore.

It is another object of the present invention to prevent the flow of water into a producing liner.

It is another object of the present invention to produce oil and gas from zones having different pressures.

It is still another object of the present invention to provide a liner system, having a mandrel-packer assembly that can be opened and closed within the wellbore so as to allow or prevent a flow of fluid into the producing liner.

It is another object of the present invention to provide a liner system, having a mandrel-packer assembly, wherein the mandrel longitudinally extends within the interior of packers after the packers have been locked in position by expansion within the wellbore.

It is another object of the present invention to maximize oil and gas production for any number and combination of zones within a wellbore.

It is still another object of the present invention to provide a liner system, having a mandrel-packer assembly, wherein the mandrel that can be installed with packers affixed thereto and that can adjust longitudinally through the packers, after the packers are expanded in place against the wellbore.

It is another object of the present invention to provide a liner system that can be used in vertically and horizontally-extending wells.

It is another object of the present invention to provide a liner system for injection wells and producing wells.

It is another object of the present invention to isolate the various zones of a wellbore that have no casing or liner.

It is another object of the present invention to support the walls of a wellbore with expandable packers.

It is another object of the present invention to provide a liner system that is easily placed within a wellbore.

It is still another object of the present invention to provide a liner system that withstands wellbore conditions associated with oil and gas production, including but not limited to environmental conditions related to geothermal temperatures and pressure.

It is another object of the present invention to provide a liner system where the packer is releasably affixed to the outer surface of the mandrel.

These and other objects and advantages of the present invention will become apparent from a reading of the attached specification and appended claims.

BRIEF SUMMARY OF THE INVENTION

The present invention is a geothermal liner system with packer that seals a producing zone within a wellbore, comprising a plurality of joint casings, a mandrel placed in an interior of the wellbore in sequence with the joint casings, a packer releasably affixed around an outer surface of the mandrel, and a sleeve positioned adjacent an end of the mandrel. The liner is generally tubular because the joint casings and mandrels are tubular-shaped. The mandrel is a component within the liner. The packer is of a material that is expandable upon contact with fluids in the wellbore, and there can be more than one packer in the liner system. The mandrel is longitudinally slidable within an interior of the packer. The sleeve has a plurality of perforations in a wall thereof and is independently activated to open or close the perforations with respect to the wellbore. The sleeve is placed in the open position so as to allow production of fluid from the corresponding wellbore zone. The sleeve can be placed in the closed position so as to prevent fluid flow into the liner, such as during installation and positioning of the mandrel in the wellbore.

The packer comprises a packing structure having a channel formed therein, a packer element received in the channel of the packing structure, and a fusible link connected to the packing structure. The packing structure is slidable relative to the outer surface of the mandrel, after the packer element has expanded in an annular space between the packing structure and the wellbore upon contact with the fluids in the wellbore. The fusible link is releasably affixed to the outer surface of the mandrel. During installation and while traveling through the wellbore, the fusible link fixes the packer to the mandrel. After reaching the planned destination, the fusible link releases, allowing the longitudinal sliding relation between the packer and mandrel.

The packing structure comprises a tubular element slidably positioned on the outer surface of the mandrel, a first end portion affixed to an end of the tubular element, and a second end portion affixed to an opposite end of the tubular element. The first end portion and the second end portion and the tubular element form the channel.

The fusible link comprises a first connection affixed to the first end portion of the packing structure, and a second connection affixed to the second end portion of the packing structure. The first connection is releasably affixed to the outer surface of the mandrel. The second connection is releasably affixed to the outer surface of the mandrel. The first and second connections are suitable for dissolving upon contact with the fluids in the wellbore. The mandrel can be a chromed mandrel and can be expanded longitudinally through the wellbore upon exposure to wellbore conditions. The sleeve has an inner diameter smaller than an outer diameter of the mandrel. The plurality of perforations are in fluid communication with an interior of the liner through the mandrel, sleeve or the joint casings.

The present invention is an apparatus for sealing a producing zone within a wellbore comprising a first packing assembly having a mandrel and a packer, a sleeve having an end positioned adjacent an end of the mandrel of the first packing assembly, and a second packing assembly having a mandrel and a packer. The mandrel of the second packing assembly has an end positioned adjacent an opposite end of the sleeve. The packer of the first packing assembly is releasably affixed to the mandrel of the first packing assembly. The packer of the second packing assembly is releasably affixed to the mandrel of the second packing assembly. The sleeve has a plurality of perforations in a wall thereof. The mandrels of the first and second packing assemblies are slidable relative to the packers, after the packers have expanded. The sleeves are separately controlled to expose the perforations to the isolated wellbore selectively. The perforations are selectively opened and closed without regard to the expansion and sliding relation between the mandrels and packers. The plurality of perforations of the sleeve can be in fluid communication with the liner through an interior of the mandrel at the first packing assembly and an interior of the mandrel at the second packing assembly.

The packers of the first and second packing assemblies each have a packing structure having a channel therein, a packer element received in the channel of the packing structure, and a fusible link connected to the packing structure. The packing structure is slidable relative to an outer surface of the mandrel. The packer element is expandable in an annular space between the packing structure and the wellbore upon contact with fluids in the wellbore. The fusible link is releasably affixed to the outer surface of the mandrel. The fusible link fixes the packing structure in place until the wellbore conditions release the fusible link. The packing structure comprises a tubular element slidably positioned on the outer surface of the mandrel, a first end portion affixed to an end of the tubular element, and a second end portion affixed to an opposite end of the tubular element. The first end portion and the second end portion and the tubular element form the channel. The fusible link has a first connection affixed to the first end portion of the packing structure, and a second connection affixed to the second end portion of the packing structure. The first connection is releasably affixed to the outer surface of the mandrel. The second connection is releasably affixed to the outer surface of the mandrel. As such, the first and second connections are suitable for dissolving upon contact with the fluids in the wellbore.

DETAILED DESCRIPTION OF THE INVENTION

Figure 1:
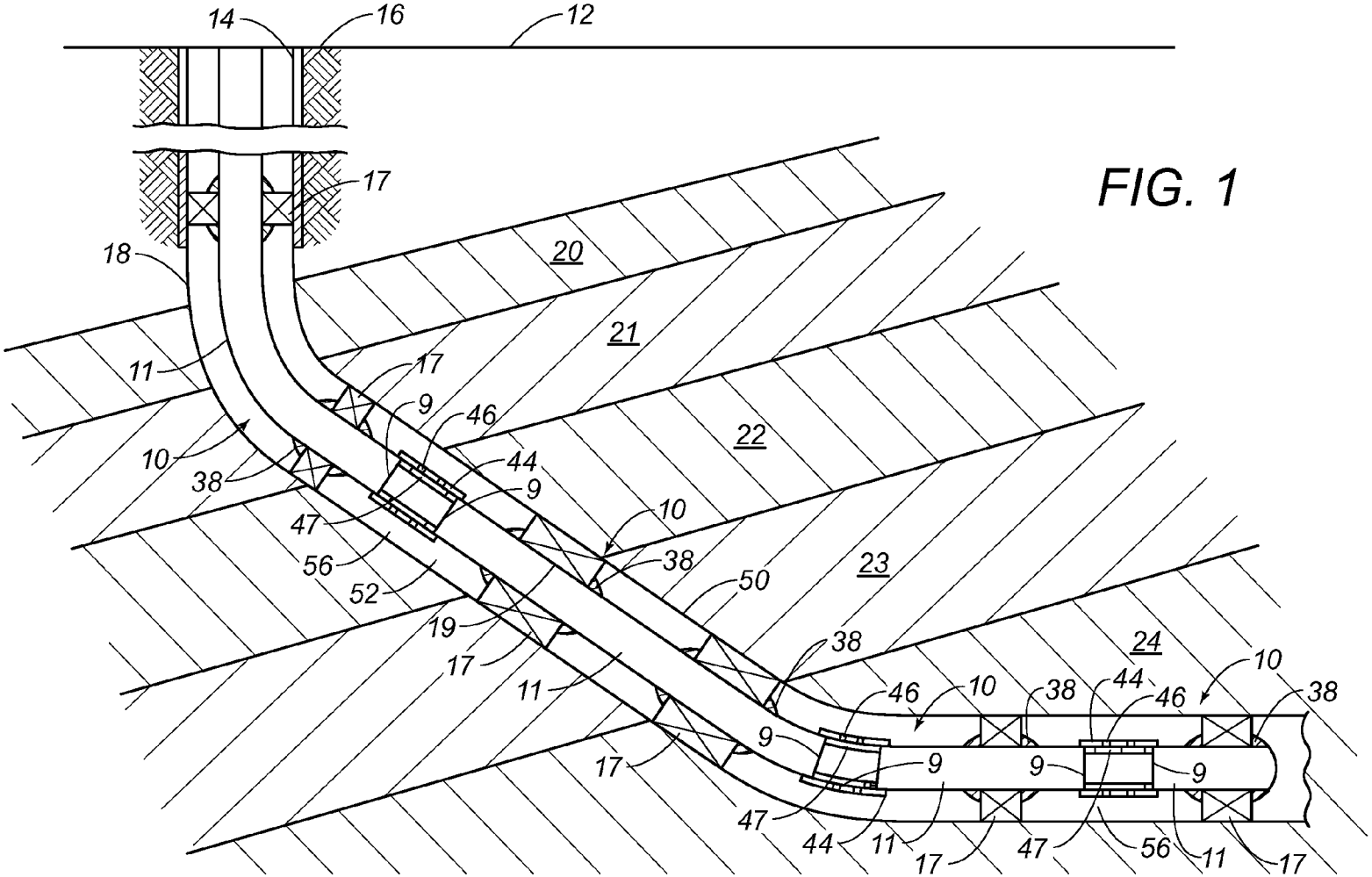
FIG. 1 shows a cross-sectional view of a well bore in a land formation, with the preferred embodiment of the apparatus of the present invention therein.

Referring to FIG. 1, there is shown a cross-sectional view of a land formation 16, with the preferred embodiment of the apparatus 10 of the present invention inserted within a wellbore 50 that has been formed in the land formation 16. The land formation 16 has a water-producing layer 20, a non-producing layer 21 below the water-producing layer 20, an oil-and-gas layer 22 below the non-producing layer 21, another water layer 23 below the oil-and-gas layer 22, and another oil-and-gas layer 24 below the water layer 23. The wellbore 50 extends vertically and diagonally through the water-producing layer 20. The wellbore 50 extends diagonally through the non-producing layer 21, the oil-and-gas layer 22, the other water layer 23, and a portion of the oil-and-gas layer 24. The wellbore 50 extends horizontally through oil-and-gas layer 24. The various layers 20, 21, 22, 23 and 24 are also referred to as zones. These zones can reside at a great depth below the surface 12 of the land formation 16. Near the surface 12 of the land formation 16, the wellbore 50 has casing 14 on the walls 18 thereof. The casing 14 adds structural integrity to the wellbore 50. The casing 14 is not used within the wellbore 50 when the wellbore 50 turns diagonally or horizontally through the land formation 16. Because the wellbore 50 cuts through the water-producing zones 20 and 23 and the oil-and-gas producing zones 22 and 24, water and oil and gas will seep into the wellbore 50. These fluids will mix and be urged upward towards the surface 12 of the land formation 16 unless an obstruction keeps them from moving upwardly in the wellbore 50.

The apparatus 10 of the present invention seals the producing zones 20, 22, 23, and 24 from one another within the wellbore 50, and only allows the oil-and-gas producing zones 22 and 24 to produce fluid that moves upwardly through the liner by joint casings or mandrels 11 toward the surface 12 of the land formation 16 within the wellbore 50. The apparatus 10 has a mandrel 11 placed in an interior 52 of the wellbore 50. The liner has a generally tubular shape because the joint casings and mandrels 11 have a tubular shape. The joint casings are tubular elements that extend the length of the liner through the wellbore. A packer 17 is releasably affixed around an outer surface 15 of the mandrel 11. The packer 17 is of a material that is expandable upon contact with fluids in the wellbore 50. There can be more than one packer 17 in a system of the present invention 10. The mandrel 11 is slidable within the interior 19 of the packer 17, when the packer 17 is expanded and released. A sleeve 44 is positioned adjacent an end 9 of the mandrel 11 and has perforations 46 in a wall 47 thereof.

In FIG. 1, packers 17 are placed so that any water produced from zone 20 cannot move upwardly or downwardly within the wellbore 50. The annular space 56 between the outer surface 15 of the mandrel 11 and the wall 18 of the wellbore 50 may fill with water in the region between packers 17; however, the water will remain within this space and not be produced. Any water that is produced in zone 23 is also blocked from flowing within the wellbore 50 by packers 17. Although the mandrel 11 passes by the water-producing zones 20 and 23, there are no sleeves with perforations that allow the water to flow into the interior 19 of the mandrel 11 so as to be produced. In the oil-and-gas zones 22 and 24, sleeves 44 are incorporated with the mandrel 11 so as to allow oil and gas to enter the perforations 46 of the sleeve 44 and thus enter the liner for production at the surface 12. The ends 9 of the mandrel 11 and the wellbore 50 of FIG. 1 are spaced apart so as to allow fluids of oil and gas to enter the perforations 46 of the sleeves 44 and into the liner.

As will be explained in more detail below, the sleeves 44 can be placed in an open position, for example in FIG. 1, so that fluid can flow through the sleeves 44 and into the liner, including the mandrels 11. The mandrels 11 are longitudinally slidable within the wellbore 50, relative to the fixed packers, after the packers 17 swell within the wellbore 50, so as to account for thermal expansion of the mandrel 11 due to wellbore conditions, such as geothermal heat. Prior to the apparatus 10 of the present invention, this was not possible. The wellbore conditions would expand and rupture the sealed packer installations because the packers 17 remained fixed on the liner. In the apparatus 10, the fusible links of the packer 17 that affixed the packer 17 to the outer surface 15 of the mandrel 11 are released from the outer surface 15 after the packers 17 swelled within the wellbore 50. Thus, the mandrels 11 are now longitudinally slidable within the interior 19 of the packers 17 relative to the packers 17, allowing for stability of the entire liner system through various environmental stress in the wellbore.

Figure 2:
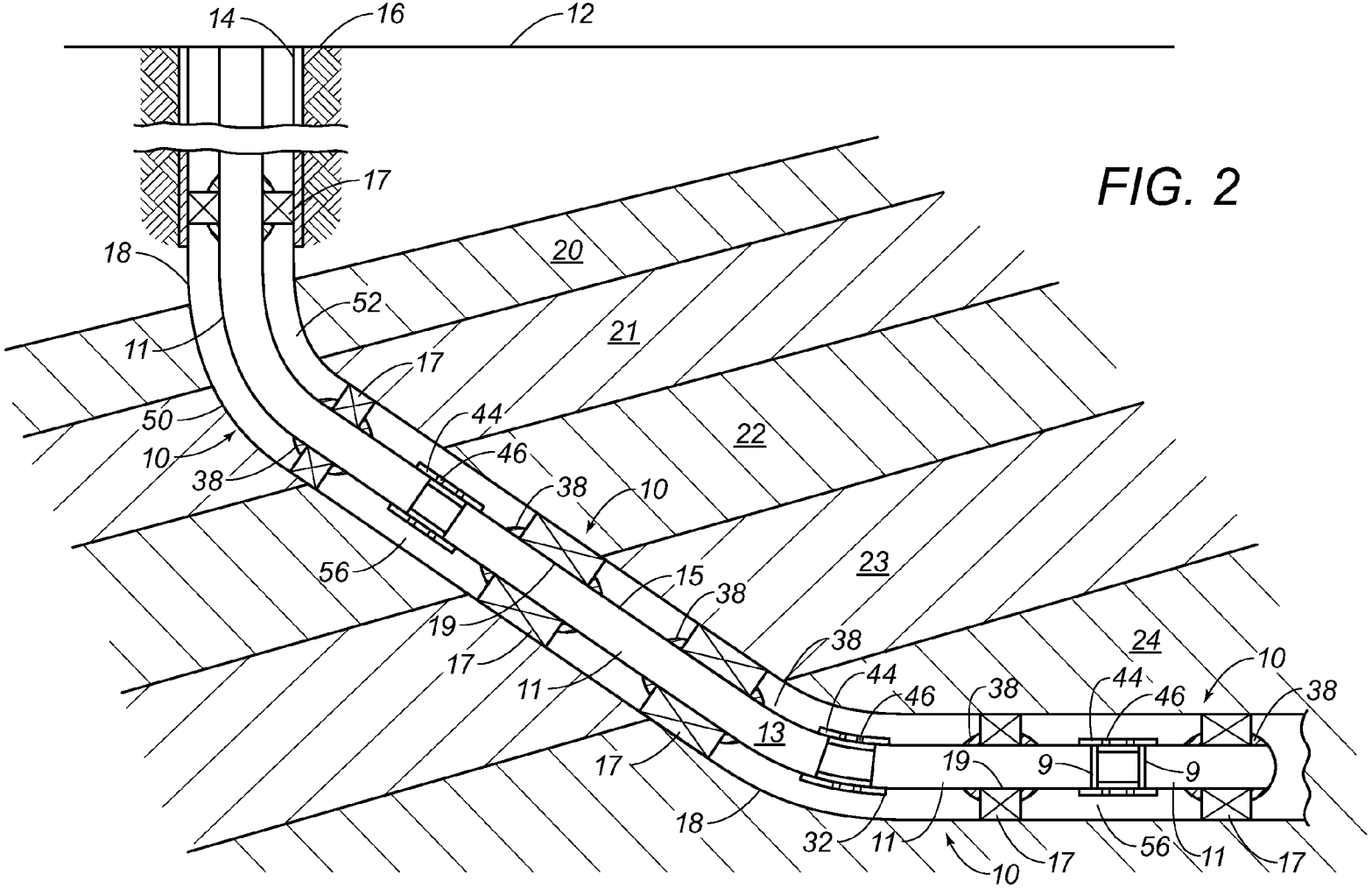
FIG. 2 shows a cross-sectional view of the wellbore in the land formation, with the preferred embodiment of the present invention adjusted therein.

Referring to FIG. 2, there is shown a cross-sectional view of the land formation 16, with the liner, including joint casings and mandrels 11 moved relative to the packers 17 within the wellbore 50. The sleeve 44 in zone 24 that produces oil and gas is shown in the open position so as to allow oil and gas fluids to flow through the perforations 46 in the sleeves 44 and into the interior 13 of the liner. The sleeves 44 are separately controlled with regard to the thermal expansion of the liner, including the joint casings and mandrels 11. The sleeves 44 are selectively opened, and the liner system of the present invention maintains the sealed zones, accounting for various wellbore conditions, by movable mandrels 11. The sleeves 44 are tubular in shape so as to fit over and into the ends 9 of the mandrels 11. In FIG. 2, the ends 9 of the mandrels 11 in zone 22 are longitudinally expanded because of geothermal heat in the wellbore. The sleeve 44 maintains control of the fluid access to the wellbore in any expanded or non-expanded status of the mandrels. Production of oil and maintenance of the fluid connection are not determined by particular mandrel movement because collection may need to occur in a particular zone without regard to any expansive movement of any particular mandrel 11. The present invention presents a simple and effective solution to maintain the sealed zones without ruptures from various wellbore conditions, such as geothermal powered expansion, and fluid access controlled by sleeves. The present invention is a more stable system to install a liner with the packers in the proper locations and to maintain the sealed zones for fluid collection.

The movement of the mandrels 11 relative to the packers 17 is made possible by the fusible links 38 releasably attached to each packer. In prior art, each packer 17 would be fixed to the outer surface 15 of the mandrels 11. In the present invention, the packers 17 are affixed to the outer surface 15 of the mandrels 11 when the packers 17 and mandrels 11 are inserted within the wellbore 50. After the packers 17 expand within the wellbore 50 so as to fix the apparatus 10 within the wellbore 50, the fusible links 38 release from the outer surface 15 of the mandrels 11 so as to allow the mandrels 11 to longitudinally expand and slide within the interior 19 of the packers 17. The packers 17 thus stay in place within the mandrels 11 and support both the wall 18 of the wellbore 50 and the outer surface 15 of the mandrels 11 within the wellbore 50 while the mandrels 11 adjust to wellbore conditions within the interior 19 of the packers 17.

Figure 3:
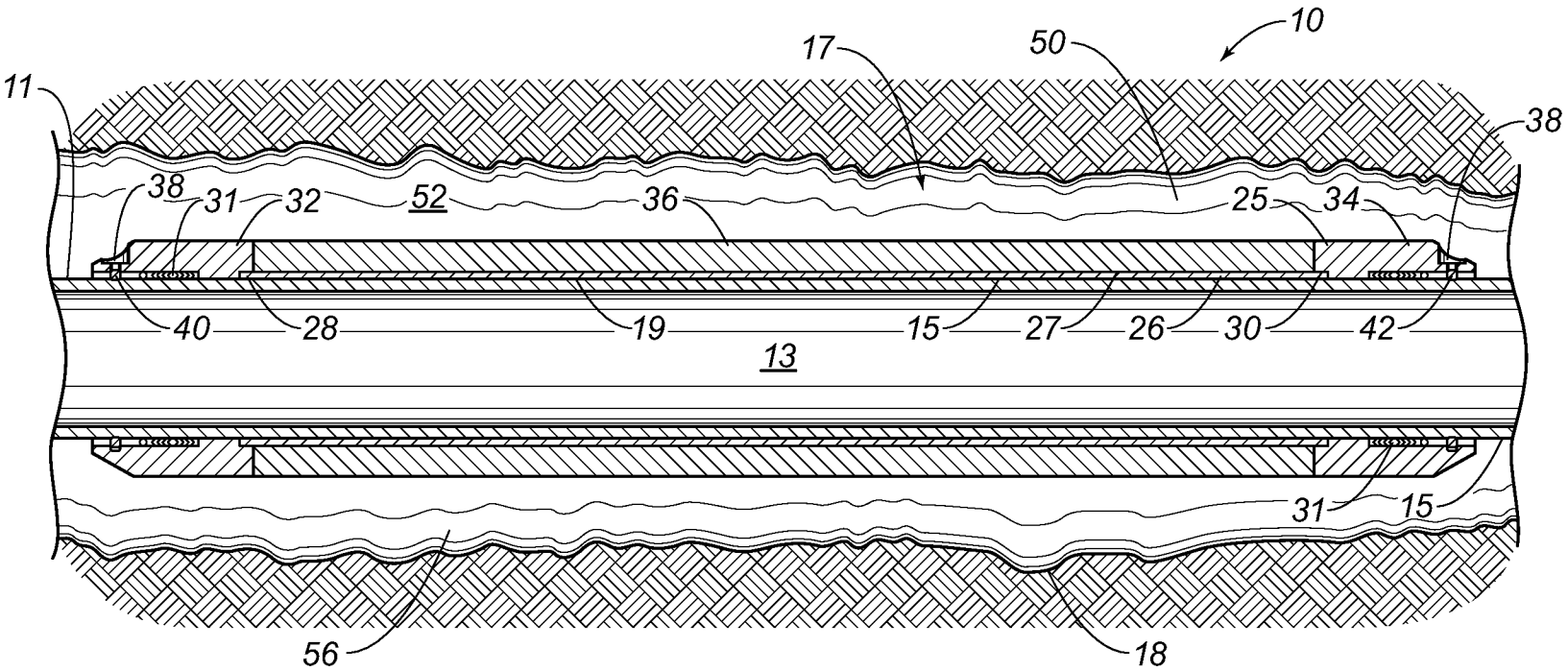
FIG. 3 shows an isolated cross-sectional view of the apparatus of the present invention within a wellbore.

Referring to FIG. 3, there is shown an isolated cross-sectional view of a packer 17 and mandrel 11 inserted within the wellbore 50. The apparatus 10 is shown as residing within the wellbore 50 before the packer 17 has expanded within the wellbore 50. The mandrel 11 is a chromed mandrel. The chromed mandrel is resistant to certain contaminants and corrosives that are contained in the fluids that are produced within the wellbore 50. The packer 17 is releasably affixed to the outer surface 15 of the mandrel 11.

The packer 17 has a packing structure 25. The packing structure has a channel 27 formed therein. The packer 17 has a packer element 36 that is received within the channel 27 of the packing structure 25. The packer element 36 is expandable in the annular space 56 between the packer structure 25 and the wellbore 50 upon contact with the fluids in the wellbore 50. The packer 17 also has a fusible link 38 that is connected to the packer structure 25. The fusible link 38 is releasably affixed to the outer surface 15 of the mandrel 11. The packing structure 25 can be slidable relative to the outer surface 15 of the mandrel 11, after the fusible links release. Specifically, the packing structure 25 has a tubular element 26 that is slidably positioned on the outer surface 15 of the mandrel 11. A first end portion 32 is affixed to an end 28 of the tubular element 26. A second end portion 34 is affixed to an opposite end 30 of the tubular element 26. The first end portion 32 and the second end portion 34 and the tubular element 26 form the channel 27 of the packing structure 25. The tubular element 26 extends radially outwardly from the outer surface 15 of the mandrel 11 for a distance less than a distance which the first and second end portions 32 and 34 extend radially outwardly from the outer surface 15 of the mandrel 11. A packing 31 is placed on a bottom of each of the first and second end portions 32 and 34 so that the first and second end portions 32 and 34 slide easily along the outer surface 15 of the mandrels 11. The fusible link 38 of the packer 17 has a first connection 40 affixed to the first end portion 32 of the packing structure 25 and a second connection 42 affixed to the second end portion 34 of the packing structure 25. The first connection 40 is releasably affixed to the outer surface 15 of the mandrel 11. The second connection 42 is releasably affixed to the outer surface 15 of the mandrel 11. The first and second connections 40 and 42 are suitable for dissolving upon exposure to wellbore conditions. Particular wellbore conditions, such as temperature and pressure, can be pre-determined for a liner system to be placed in the wellbore 50. The mandrel 11 is also expandable upon exposure to wellbore conditions. Once fluids from the land formation fill within the annular space 56 of the wellbore 50, the packer element 36 expands radially outwardly from the outer surface 15 of the mandrel 11 so as to abut the wall 18 of the wellbore 50. As needed, the mandrel 11 can expand in response to heat, mechanical forces, or chemical reactions. While the packer element 36 is expanding, the first and second connections 40 and 42 of the fusible links 38 dissolve or release when exposed to the wellbore conditions at the determined place within the wellbore 50. Once the fusible links 38 are dissolved, the first and second end portions 32 and 34 and the tubular element 26 of the packing structure 25 can slide longitudinally relative to the outer surface 15 of the mandrel 11. The ends of the first and second end portions 32 and 34 taper toward the outer surface 15 of the mandrel 11. The packing structure 25 can be made of any material suitable for oil and gas operations within the wellbore 50. The packer element 36 is preferably made of a material suitable for expanding within a wellbore 50 producing oil and gas, such as a polymer or elastomer. The packing 31 can be made of a slidable friction-reducing material such as polytetrafluoroethylene. The mandrels 11 are typical of production tubing used in oil and gas wells. The mandrels 11 can be chromed, as stated above.

Figure 4:
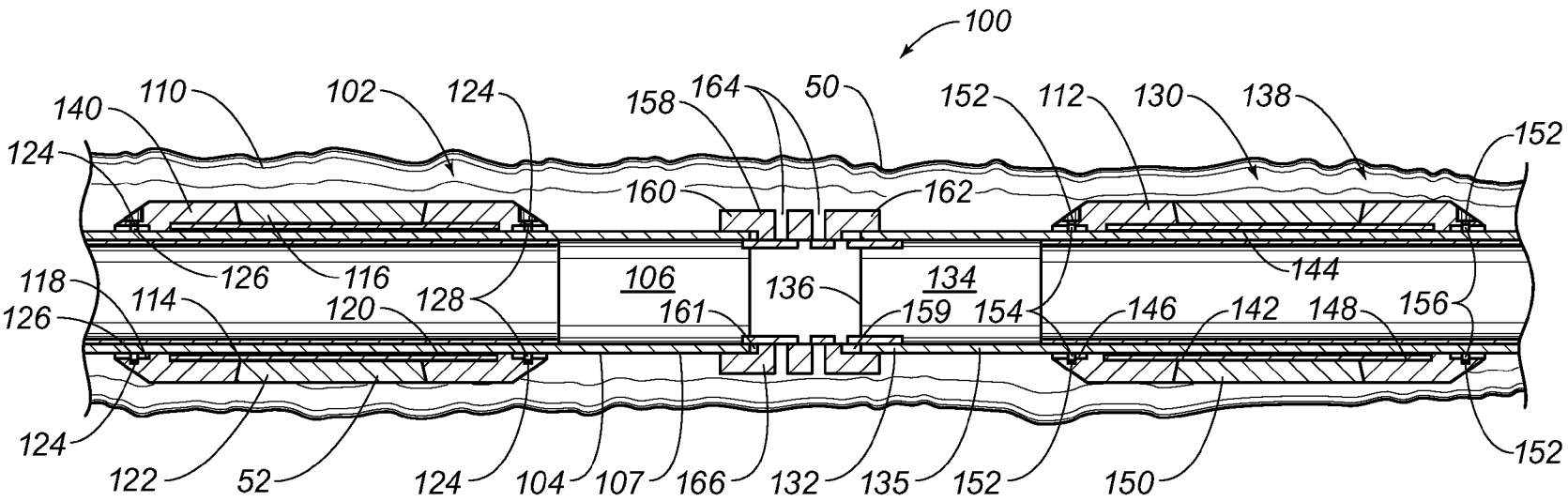
FIG. 4 shows an isolated cross-sectional view of first and second packer assemblies within a wellbore fixedly positioned on the mandrel during installation, the perforations being closed to the interior of the mandrel.

Referring to FIG. 4, there is shown an isolated cross-sectional view of apparatus 100 of the present invention with a first packing assembly 102 and a second packing assembly 130. The first packing assembly 102 has a mandrel 104 and a packer 110. The packer 110 of the first packing assembly 102 is releasably affixed to the mandrel 104. The second packing assembly 130 has a mandrel 132 and packer 138. The packer 138 of the second packing assembly 130 is releasably affixed to the mandrel 132 of the second packing assembly 130. The apparatus 100 also has a sleeve 158 that has an end 160 positioned adjacent an end 108 of the mandrel 104 of the first packing assembly 102. The sleeve 158 has perforations 164 formed in a wall 166 thereof. The mandrel 132 of the second packing assembly 130 has an end 136 positioned adjacent an opposite end 162 of the sleeve 158. The mandrels 104 and 132 of the first and second packing assemblies 102 and 130, respectively, are slidable relative to the packers 110 and 138. As shown, the sleeve 158 is in a closed position during this installation time with the non-expanded and affixed packers, so the perforations 164 of the sleeve 158 are not in fluid communication with an interior of the liner through either an interior 106 of the mandrel 104 of the first packing assembly 102 or an interior 134 of the mandrel 132 of the second packing assembly 130. The packer 110 of the first packing assembly 102 is similar to the packer 17 described in FIGS. 1-3. The packer 110 has a packing structure 112, a packer element 122, and a fusible link 124. The packing structure 112 has a tubular element 116, a first end portion 118, and a second end portion 120. The fusible link 124 of the first packing assembly 102 has a first connection 126 and a second connection 128. The first and second connections 126 and 128 of the first packing assembly 102 dissolve or release upon exposure to the wellbore conditions within the wellbore 50. The packer 138 of the second packing assembly 130 has packing structure 140, a packer element 150, and a fusible link 152. The packing structure 140 has a tubular element 144, a first end portion 146 and a second end portion 148. The fusible link 152 has a first connection 154 and a second connection 156. The first and second connections 154 and 156 of the second packing assembly 130 dissolve or release upon exposure to wellbore conditions within the wellbore 50.

The relation of the parts of the first packing assembly 102 and the second packing assembly 130 is substantially similar to the apparatus 10 shown in FIGS. 1-3. In FIG. 4, the end 108 of the mandrel 104 of the first packing assembly 102 and the end 136 of the mandrel 132 of the second packing assembly are being installed. In the typical installation of the apparatus 100 within a wellbore 50, the ends 108 and 136 of the mandrels 104 and 132 and sleeve 158 are abutted while placing the apparatus 100 within the wellbore 50. The sleeve 158 is now shown in a closed position, such that the perforations do not expose the wellbore to the interior of the liner through either mandrels 104 and 132 for production through the liner. The sleeve 158 has an inner diameter that is smaller than the outer diameter of the mandrels 104 and 132. When the mandrels 104 and 132 move within the wellbore 50, the packers 110 and 138 remain in position on the respective mandrels 104 and 132 within the wellbore 50.

Figure 5:
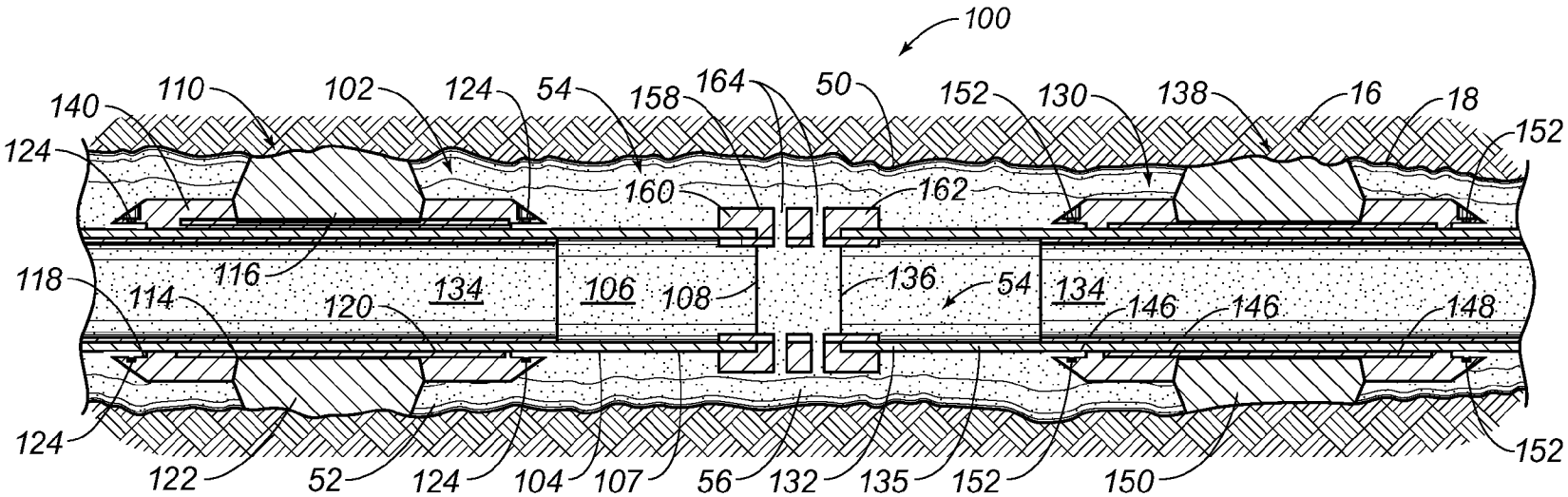
FIG. 5 shows an isolated cross-sectional view of the first and second packing assemblies, with the packers expanded within the wellbore and the fusible link released, the mandrels being longitudinally moveable so as to allow for expansion by geothermal heat, and the perforations being open for fluid to flow into the mandrel.

Referring to FIG. 5, there is shown an isolated cross-sectional view of the preferred embodiment of the apparatus 100 of the present invention, with the packers 122 and 150 swollen in response to exposure to wellbore conditions, such as fluids 54 within the wellbore 50. As discussed above, the wellbore 50 is a hole created in the land formation 16. If land formation 16 is saturated with oil and gas, oil and gas will seep through the wall 18 of the wellbore 50 into the annular space 56 between the packing assemblies 102 and 130 and the wall 18 of the wellbore 50. The fluid 154 within the wellbore 50 caused the packer elements 122 and 150 to swell against the wall 18 of the wellbore 50. Also, the fluid 154 caused the first and second connections of the fusible links 124 and 152 to dissolve so as to release the packing structures 132 and 140 from the outer surface 107 and 135 of the mandrel 104 and 132. Because the mandrels 104 and 132 are slidable relative to the packers 110 and 138, the ends 108 and 136 of the mandrels 104 and 132 maintain the sealed zone of the packer elements 122 and 15. The sleeve is shown in an open position, exposing the perforations to the wellbore fluid. The perforations 164 of the sleeve 158 are separately controlled to be exposed to the interiors 106 and 134 of the mandrels 104 and 132. After the packer elements 150 and 122 swell in response to the wellbore conditions within the wellbore 50 and the first connections 126 and 154 and second connections 128 and 156 dissolve this same exposure within the wellbore 50, the mandrels 104 and 132 within the wellbore 50 can longitudinally slide relative to the packers 110 and 138, respectively. The mandrels 104 and 132 can expand or contract in spaces 159 and 161 due to wellbore conditions, such as geothermal heat, while the packers 110 and 138 remain in the sealed state. This arrangement allows fluid within the wellbore 50 to pass through the perforations 164 of the sleeve 158 and through the interiors 134 and 106 of the mandrels 132 and 104, respectively, for production through the interior of the liner.

Figure 6:
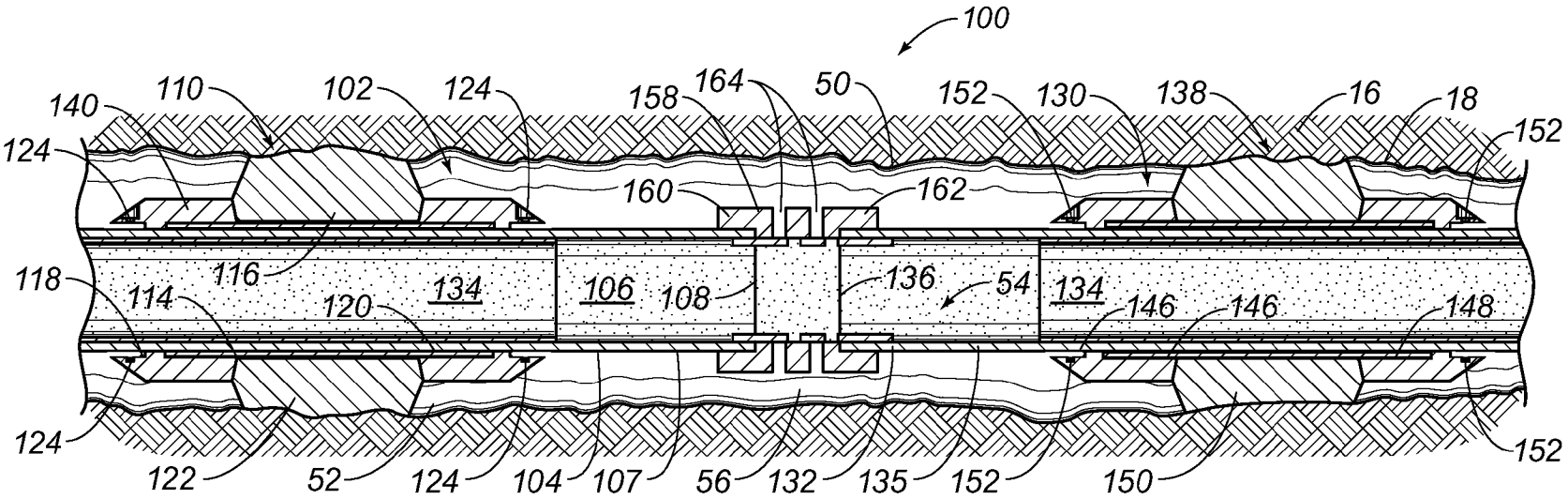
FIG. 6 shows an isolated cross-section view of the first and second packing assemblies, with the packers expanded within the wellbore and the fusible link release, the mandrels still being longitudinally moveable so as to allow for expansion, and the perforations being closed by the sleeve to block the flow of fluid into the mandrel so as to allow production of fluid from another zone.

Referring to FIG. 6, there is shown an isolated cross-section view of the apparatus 100 of the present invention, the first packing assembly 102 and the second packing assembly 130 in an expanded state. The mandrels 104 and 132 moved relative to the packers 110 and 130 within the wellbore 50, such as when the land formation 16 no longer produces oil and gas. The sleeve 158 remains closed, regardless of the expansion and sliding of the mandrels 104 and 132 through time. The sleeve could also be re-opened for venting, regardless of the expansion or contraction of the mandrels over time. Thus, a stable system of a liner system with a packer is provided by the present invention. Wellbore conditions, like geothermal heat, no longer pose problems to the pumping activity or maintenance of the sealed zones.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A liner system for sealing a producing zone within a wellbore comprising:

a mandrel placed in an interior of the wellbore, said mandrel having a tubular shape;

a packer releasably affixed around an outer surface of said mandrel, said packer being comprised of a material expandable upon exposure to wellbore conditions, said mandrel being slidable longitudinally within an interior of said packer when said packer is in an expanded state and set in the wellbore; and a sleeve positioned adjacent an end of said mandrel, said sleeve having a plurality of perforations in a wall thereof, wherein said sleeve has an inner diameter smaller than an outer diameter of said mandrel, said plurality of perforations being selectively positioned in and out of fluid communication with an interior of the liner system.

2. The liner system of claim 1, said packer comprising:

a packing structure having a channel formed therein;

a packer element received in said channel of said packing structure, said packer element being expandable in an annular space between said packing structure and the wellbore upon exposure to wellbore conditions; and a fusible link connected to said packing structure, said fusible link being releasably affixed said outer surface of said mandrel, said packing structure being longitudinally slidable relative to said outer surface of said mandrel when said fusible link is released, said packer being slidable relative to said outer surface of said mandrel when said fusible link is released.

3. The liner system of claim 2, said packing structure comprising:

a tubular element slidably positioned on said outer surface of said mandrel;

a first end portion affixed to an end of said tubular element; and a second end portion affixed to an opposite end of said tubular element, said first end portion and said second end portion and said tubular element forming said channel.

4. The liner system of claim 3, said fusible link comprising:

a first connection affixed to said first end portion of said packing structure, said first connection being releasably affixed to said outer surface of said mandrel; and a second connection affixed to said second end portion of said packing structure, said second connection being releasably affixed to said outer surface of said mandrel.

5. The liner system of claim 4, the first and second connections being suitable for dissolving or releasing upon exposure to wellbore conditions.

6. The liner system of claim 1, said mandrel being a chromed mandrel.

7. A liner system for sealing a producing zone within a wellbore comprising:

a mandrel placed in an interior of the wellbore, said mandrel having a tubular shape; and a packer releasably affixed around an outer surface of said mandrel, said packer being comprised of a material expandable upon exposure to wellbore conditions, said packer comprising:

a packing structure having a channel therein;

a packer element received in said channel of said packing structure, said packer element being expandable in an annular space between said packing structure and the wellbore upon exposure to wellbore conditions; and a fusible link connected to said packing structure, said fusible link being releasably affixed said outer surface of said mandrel, said mandrel being slidable within an interior of said packer when said fusible link is released, said packing structure being slidable relative to said outer surface of said mandrel when said fusible link is released, said packer being slidable relative to said outer surface of said mandrel when said fusible link is released.

8. The liner system of claim 7, further comprising:

a sleeve positioned adjacent an end of said mandrel, said sleeve having a plurality of perforations in a wall thereof, said plurality of perforations being selectively positioned in and out of fluid communication with an interior of the liner system.

9. The liner system of claim 7, said packing structure comprising:

a tubular element slidably positioned on said outer surface of said mandrel;

a first end portion affixed to an end of said tubular element; and a second end portion affixed to an opposite end of said tubular element, said first end portion and said second end portion and said tubular element forming said channel.

10. The liner system of claim 9, said fusible link comprising:

a first connection being affixed to said first end portion of said packing structure and being a first pin releasably affixed to said outer surface of said mandrel; and a second connection being affixed to said second end portion of said packing structure and being a second pin being releasably affixed to said outer surface of said mandrel.

11. The liner system of claim 10, the first and second connections suitable for dissolving upon exposure to wellbore conditions.

12. The liner system of claim 7, said mandrel being a chromed mandrel.

13. The liner system of claim 8, said sleeve having an inner diameter smaller than an outer diameter of said mandrel, said plurality of perforations being selectively positioned in and out of fluid communication with an interior of the liner system.

14. A liner system for sealing a producing zone within a wellbore comprising:

a first packing assembly having a mandrel and a packer, said packer of said first packing assembly being releasably affixed to said mandrel of said first packing assembly;

a sleeve having an end positioned adjacent an end of said mandrel of said first packing assembly, said sleeve having a plurality of perforations in a wall thereof;

a second packing assembly having a mandrel and a packer, said packer of said second packing assembly being releasably affixed to said mandrel of said second packing assembly, said mandrel of said second packing assembly having and end positioned adjacent an opposite end of said sleeve, the mandrels of the first and second packing assemblies being slidable relative to respective packing assemblies, when the first and second packer assemblies are in expanded states and set in the wellbore, wherein said plurality of perforations of said sleeve are selectively positioned in and out of fluid communication with an interior of the liner system through an interior of said mandrel of said first packing assembly and an interior of said mandrel of said second packing assembly.

15. The liner system of claim 14, each packer of said packers of said first and second packing assemblies comprising:

a packing structure having a channel therein;

a packer element received in said channel of said packing structure, said packer element being expandable in an annular space between said packing structure and the wellbore upon exposure to wellbore conditions; and a fusible link connected to said packing structure, said fusible link being releasably affixed said outer surface of said mandrel, said packing structure being slidable relative to an outer surface of said mandrel when said fusible link is released, each packer being slidable relative to an outer surface of each mandrel when said fusible link is released.

16. The liner system of claim 15, said packing structure comprising:

a tubular element slidably positioned on said outer surface of said mandrel;

a first end portion affixed to an end of said tubular element; and a second end portion affixed to an opposite end of said tubular element, said first end portion and said second end portion and said tubular element forming said channel.

17. The liner system of claim 16, said fusible link comprising:

a first connection affixed to said first end portion of said packing structure, said first connection being releasably affixed to said outer surface of said mandrel; and a second connection affixed to said second end portion of said packing structure, said second connection being releasably affixed to said outer surface of said mandrel.

18. The liner system of claim 17, the first and second connections suitable for dissolving upon exposure to wellbore conditions.

* * * * *